US009142371B2

(12) United States Patent
Hae et al.

(10) Patent No.: US 9,142,371 B2
(45) Date of Patent: Sep. 22, 2015

(54) ACTUATOR FOR CONTACTOR

(71) Applicant: HITACHI, LTD., Tokyo (JP)

(72) Inventors: Takamitsu Hae, Tokyo (JP); Ayumu Morita, Tokyo (JP); Masato Yabu, Tokyo (JP); Akio Nakazawa, Tokyo (JP); Kenji Tsuchiya, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 14/295,473

(22) Filed: Jun. 4, 2014

(65) Prior Publication Data

US 2014/0361858 A1 Dec. 11, 2014

(30) Foreign Application Priority Data

Jun. 5, 2013 (JP) ..... 2013-118526

(51) Int. Cl.

| | |
|---|---|
| ***H01H 51/08*** | (2006.01) |
| ***H01H 33/666*** | (2006.01) |
| ***H01H 50/16*** | (2006.01) |
| ***H01H 50/54*** | (2006.01) |
| ***H01H 50/64*** | (2006.01) |

(52) U.S. Cl.

CPC ..... *H01H 33/6662* (2013.01); *H01H 50/16* (2013.01); *H01H 50/54* (2013.01); *H01H 50/64* (2013.01); *H01H 2033/6667* (2013.01)

(58) Field of Classification Search

CPC ..... H01H 45/00; H01H 3/503; H01H 3/00; H01H 2003/506; H01H 50/541; H01H 50/323; H01H 33/66; H01H 33/6662; H01H 33/6641; H01H 33/6644; H01H 51/04; H01H 2221/022; H01H 2221/016

USPC ..... 335/137

See application file for complete search history.

(56) References Cited

U.S. PATENT DOCUMENTS

| | | | | | |
|---|---|---|---|---|---|
| 2,735,968 | A | * | 2/1956 | Bogue et al. | 335/275 |
| 3,465,270 | A | * | 9/1969 | Schattler | 335/132 |
| 3,568,008 | A | * | 3/1971 | Tanimura et al. | 361/155 |
| 3,622,925 | A | * | 11/1971 | Rose | 335/186 |
| 3,740,682 | A | * | 6/1973 | Schantz | 335/186 |
| 4,338,583 | A | * | 7/1982 | Mathieu | 335/186 |
| 4,506,242 | A | * | 3/1985 | Karpe et al. | 335/120 |
| 4,703,294 | A | * | 10/1987 | Yokoyama et al. | 335/121 |
| 5,049,845 | A | * | 9/1991 | Yokoyama et al. | 335/133 |

(Continued)

FOREIGN PATENT DOCUMENTS

JP 05-20976 A 1/1993

*Primary Examiner* — Shawki S Ismail
*Assistant Examiner* — Lisa Homza
(74) *Attorney, Agent, or Firm* — Mattingly & Malur, PC

(57) ABSTRACT

An actuator for a contactor comprises an electromagnet having a closing coil, a holding coil, fixed cores wound with the closing coil and the holding coil respectively, a movable core provided on one side of the fixed cores, and a yoke. A main contact movable member operates to perform closing or interrupting by attraction or release of the movable core with respect to the fixed core. The actuator has a trip spring, energy-stored during the closing, that performs the interrupting upon stopping energization to the holding coil and thereby releasing the stored-energy. The actuator has an auxiliary contact operating with the operation of the movable core and performing energization switching with respect to the closing coil and the holding coil. The trip spring is provided on one side of the electromagnet in a horizontal direction while the auxiliary contact is provided on the other side.

10 Claims, 4 Drawing Sheets

(56) References Cited

U.S. PATENT DOCUMENTS

| | | | | |
|---|---|---|---|---|
| 5,053,907 | A * | 10/1991 | Nishi et al. | 361/9 |
| 5,828,281 | A * | 10/1998 | Hapke et al. | 335/286 |
| 6,268,579 | B1 * | 7/2001 | Kajiwara et al. | 218/153 |
| 2004/0141271 | A1 * | 7/2004 | Kikuchi et al. | 361/62 |
| 2005/0139579 | A1 * | 6/2005 | Sakamoto et al. | 218/118 |
| 2005/0153534 | A1 * | 7/2005 | Kikuchi et al. | 438/618 |
| 2006/0028073 | A1 * | 2/2006 | Sugino et al. | 310/49 R |
| 2006/0081560 | A1 * | 4/2006 | Kikuchi et al. | 218/123 |
| 2006/0102594 | A1 * | 5/2006 | Kikuchi et al. | 218/123 |
| 2007/0007249 | A1 * | 1/2007 | Kikuchi et al. | 218/128 |
| 2007/0175866 | A1 * | 8/2007 | Tsuchiya et al. | 218/10 |
| 2008/0067152 | A1 * | 3/2008 | Kikukawa et al. | 218/139 |
| 2008/0156775 | A1 * | 7/2008 | Morita et al. | 218/140 |
| 2008/0308531 | A1 * | 12/2008 | Tsuchiya et al. | 218/118 |
| 2009/0159568 | A1 * | 6/2009 | Ozawa et al. | 218/140 |
| 2010/0122967 | A1 * | 5/2010 | Morita et al. | 218/140 |
| 2012/0038438 | A1 * | 2/2012 | Sawada et al. | 335/6 |
| 2012/0212168 | A1 * | 8/2012 | Tsukima et al. | 318/400.26 |

* cited by examiner

ACTUATOR FOR CONTACTOR

CLAIM OF PRIORITY

The present application claims priority from Japanese Patent application serial no. 2013-118526, filed on Jun. 5, 2013, the content of which is hereby incorporated by reference into this application.

TECHNICAL FIELD

The present invention relates to an actuator for a contactor, and more particularly, to an actuator for a contactor appropriate to an actuator having an electromagnet such as an actuator for a vacuum switchgear.

BACKGROUND ART

As an example of a conventional electromagnet-installed actuator for a contactor, an actuator described in Patent Literature 1 (JP-A No. Hei 5-20976) is known. The actuator for a contactor described in the Patent Literature 1 is schematically formed with an electromagnet including a fixed core and a movable core, a yoke and coil, a trip spring (pulled-out spring), a wipe spring and the like.

The above-described trip spring is provided between a case side wall and a lever to which the movable core is fixed, and is employed to perform interrupting operation on a main contact of a vacuum switchgear by applying torque to the lever to rotate the lever. On the other hand, in the wipe spring, one end is connected to the lever while the other end is connected to the main contact movable member. It is pushed up by rotation of the lever, to apply contact pressure between the main contacts, thus employed to prevent adhesion of the main contacts upon closing.

Then, when the coil is excited, the movable core is attracted in the direction of the fixed core, and the main contact movable member is brought into contact with the main contact fixed member, via the lever interlocked to the movable core, in a closed status. When the excitation of the coil is stopped, by a repulsive force between the trip spring and the wipe spring in which energy has been stored during the closing operation, the main contact movable member moves in a contact parting direction, and is in an interrupted status from the main contact fixed member.

Generally, in an electromagnet-installed actuator for an contactor, when the closed status of the main contact is held, since the distance between the movable core and the fixed core is short and the magnetic resistance is low, the coil exciting power is lower than that upon closing operation of the main contact.

In the example of the above-described Patent Literature 1, the coil is excited then the movable core is attracted in the direction of the fixed core and the main contact is in the closed status. Immediately before the main contact is in the closed status, the coil exciting power upon holding of closed status is lowered by electronic circuit control so as to lower the coil energizing voltage. Otherwise, immediately before the main contact is in the closed status, the coil exciting power upon holding of closed status is lowered by circuit switching so as to serially connect the coil to a current limiting resistor. Thus energy consumption is saved.

CITATION LIST

Patent Literature

[Patent Literature 1] JP-A No. Hei 5-20976

SUMMARY OF INVENTION

Technical Problem

However, according to the construction in the above-described Patent Literature 1, since it is necessary to arrange the trip spring between the case side wall and the lever to which the movable core is fixed, the trip spring is horizontally set. It is necessary to ensure a sufficient horizontal length of the case, accordingly, the case has a tendency to be upsized.

Further, when a current limiting resistor is used as a means for suppressing coil exciting power upon holding of closed status of the main contact, to cool the heat generating part, as it is necessary to ensure sufficient distance from its adjacent part, it is necessary to ensure sufficiently wide space for installation of the current limiting resistor. Accordingly, the case is upsized.

At last in the construction of the Patent Literature 1, the case is upsized and the entire device is also upsized.

The present invention has been made in view of the above points, and has its object to provide an actuator for a contactor in which the case is downsized and the entire device is downsized.

Solution to Problem

The actuator for a contactor according to the present invention is, to attain the above-described object, an actuator for a contactor comprising: an electromagnet having a closing coil, a holding coil, fixed cores wound with the closing coil and the holding coil respectively, a movable core provided on one side of the fixed cores, and a yoke provided on the other side of the fixed cores, wherein a main contact movable member operates to perform electrical closing or interrupting operation of a main contact of an interrupting unit, by attraction or release of the movable core of the electromagnet with respect to the fixed core, wherein the actuator further comprises: a trip spring, energy-stored during the closing operation of the main contact of the interrupting unit, that performs an interrupting operation of the main contact of the interrupting unit when the energization to the holding coil is stopped and the energy storing is released; and an auxiliary contact, that operates with the operation of the movable core, and that performs energization switching with respect to the closing coil and the holding coil, and wherein the trip spring is provided on one side of the electromagnet in a horizontal direction while the auxiliary contact is provided on the other side.

Advantageous Effects of Invention

According to the present invention, it is possible to arrange the trip spring and the auxiliary contact adjacently to the electromagnet, and no space is required for installation of the trip spring between the electromagnet and the case side wall. Further, it is possible to suppress the coil excitation power upon holding of closing without use of current limiting resistor. Accordingly, it is possible to downsize the case and downsize the entire device.

DESCRIPTION OF EMBODIMENTS

Figure 1:
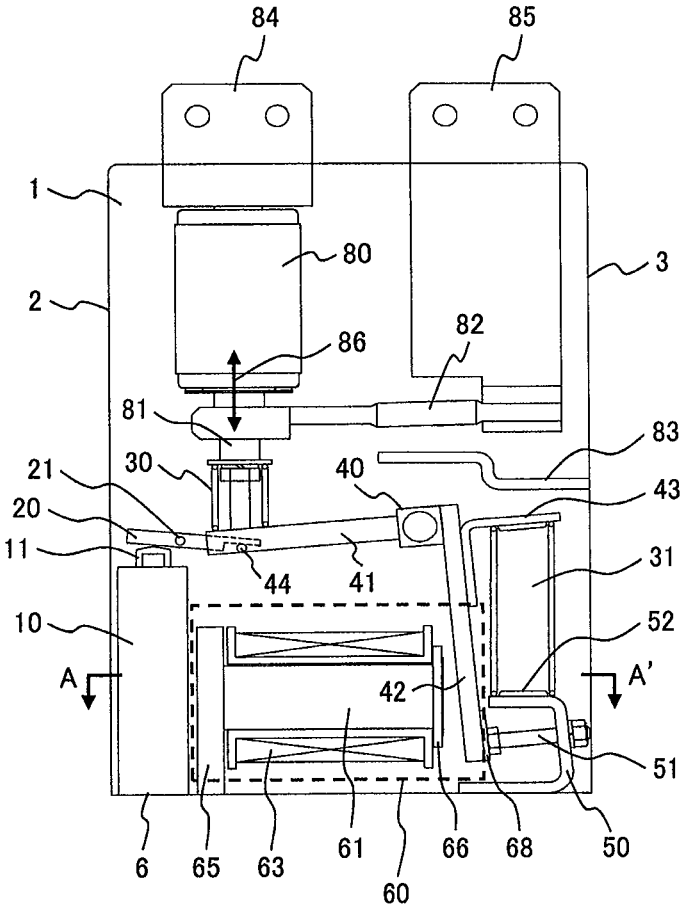
FIG. 1 is a configuration diagram, showing an embodiment 1 of an actuator for a contactor according to the present invention, and showing the inside of the case viewed from a position in front of the case.

Hereinbelow, an actuator for a contactor according to the present invention will be described based on embodiments shown in the drawings. Note that in the respective embodiments described below, the same reference numerals are used for the same constituent elements.

[Embodiment 1]

Figure 2:
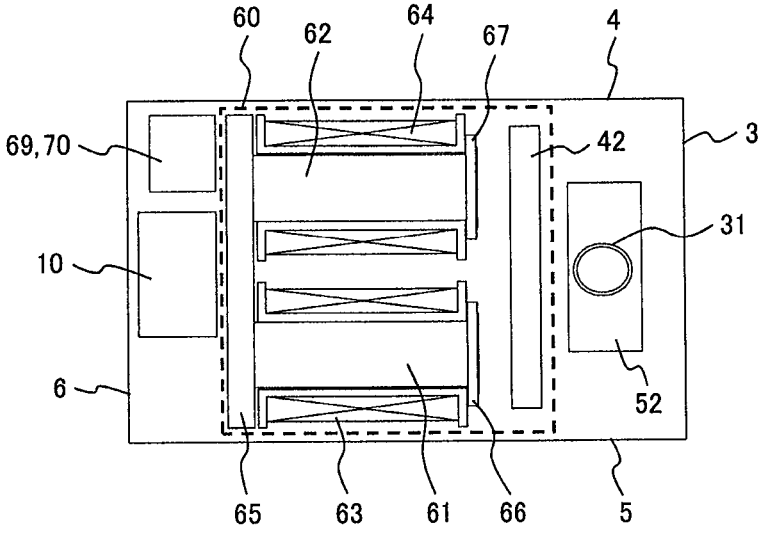
FIG. 2 is a cross-sectional diagram along an arrow A-A in FIG. 1.

FIG. 1 and FIG. 2 show an embodiment 1 of an actuator for a contactor according to the present invention.

As shown in the figures, interrupting units 80 are provided in an upper part in the case 1. One to three phases of the interrupting units 80 are provided in parallel to a drawing depthwise direction of FIG. 1, and the respective units are connected via a wipe spring 30 to a wipe spring holder 41. A vacuum-insulated or gas-insulated main contact (not shown) is installed in the interrupting unit 80. The main contact has a fixed side contact and a movable side contact. The fixed side contact is connected to a terminal 84, and the movable side contact is connected to a main contact movable member 81 and is connected via a flexible conductor 82 to a terminal 85. The main contact movable member 81 is movable in upwards and downwards directions as indicated by arrow 86.

Next, the structure of an electromagnet 60 to perform switching operation of the main contact will be described. The electromagnet 60 is schematically formed with fixed cores 61 and 62, a yoke 65 to support the fixed cores 61 and 62, a movable core 42 attracted to the fixed cores 61 and 62, a magnetic pole 66 of the fixed core 61, a magnetic pole 67 of the fixed core 62, a closing coil 63 wound on the fixed core 61 and a holding coil 64 wound on the fixed core 62.

The electromagnet 60 having this structure is a horse-shoe shape electromagnet in which the closing coil 63 and the holding coil 64 are provided in the drawing depthwise direction of FIG. 1. Further, the yoke 65, fixed on a case bottom surface 6, supports the entire electromagnet 60. The yoke 65 may have a rib member as a reinforcing member upon support of the electromagnet 60.

Further, the wipe spring holder 41 of non-magnetic material is connected via a shaft 40 to an end of the movable core 42, and the wipe spring 30 is provided between the wipe spring holder 41 on the opposite side to the connection part and the main contact movable member 81.

In FIG. 1, the main contact is in an interrupted status. The operation to close the main contact from this status is as follows.

First, the movable core 42 is attracted to the magnetic poles 66 and 67 with a magnetic attraction force generated with the both closing coil 63 and the holding coil 64. In accordance with the attraction, the wipe spring holder 41 rotates about the shaft 40 as a center in a clockwise direction, then the wipe spring 30 is pushed upward in FIG. 1, to store energy, then the main contact movable member 81 is also pushed upward, and the main contact in the interrupting unit 80 becomes in a closed status.

On the other hand, the trip spring 31 is provided between one side of a spring holder 43, having an L-shaped cross section, in which the other side is fixed to the movable core 42, and a spring holder 52 provided above a stopper 51 fixed to a stopper support base 50 having a U-shaped cross section. Note that the trip spring 31 is energy-stored during the closing operation. Further, when the main contact is interrupted, energization to the holding coil 64 is stopped while the closing of the main contact is held. As a result, the energy stored in the wipe spring 30 and the trip spring 31 is released, and the main contact movable member 81 is pushed downward in FIG. 1, then the main contact in the interrupting unit 80 becomes in an interrupted status.

Further, the stopper support base 50 having a U-shaped cross section is fixed to the case bottom surface 6 on the right side of the electromagnet 60 viewed from a front position. The stopper support base 50 support-fixes the stopper 51 of the movable core 42, and further, it also supports the trip spring 31.

Further, an auxiliary contact 10 is fixed on the case bottom surface 6 on the left side of the electromagnet 60 viewed from the front position. As the auxiliary contact 10 is a machine operation type contact, even when failure is found, it not in a conducting status but in an open status to stop energization to coil, therefore it has high safety. Further, as the auxiliary contact 10 works with the wipe spring holder 41, it has not only a function of switching energization between the closing coil 63 and the holding coil 64 but also a function of transmitting the open/close status of the interrupting unit 80 as an electric signal to the outside.

Further, the auxiliary contact 10 operates by pushing down an auxiliary contact switch 11 with a lever 20. It may be arranged as the operation of the auxiliary contact 10 such that the wipe spring holder 41 is extended above the auxiliary contact switch 11 to directly push down the auxiliary contact switch 11 upon closing operation.

The above-described lever 20 to push down the auxiliary contact switch 11, interlocked with a pin 44 provided in the wipe spring holder 41, rotates about a pin 21 as an axis. The pin 21 may be fixed to an upper part of the auxiliary contact 10 or may be fixed to an upper part of a magnetic shield 23 to be described later. Further, a status display board to check the open/close status of the main contact from the outside may be attached to an end of the wipe spring holder 41 or the lever 20.

Further, as high voltage is applied to the terminals 84 and 85 and the flexible conductor 82, they are connected to the case 1 via an insulating material (not shown). Further, in the case 1, an insulating plate 83 of insulating material is provided so as to prevent discharge with respect to the spring holder 43, the movable core 42, the shaft 40 and the wipe spring holder 41. Further, the wipe spring holder 41 is made of insulating material, to insulate high voltage applied to the main contact movable member 81.

With the above structure, it is possible to effectively utilize the space in the case 1, and it is possible to reduce the size of the case 1 in a horizontal direction in comparison with a case where the trip spring 31 is provided between the movable core 42 and the case side wall 3.

Further, the stopper 51, having e.g. a bolt structure, is capable of adjusting the gap distance between the movable core 42 and the magnetic poles 66 and 67 when the main contact is in the interrupted status. Further, the stopper support base 50 fix-supports a shock absorber (not shown) of the movable core 42 together with the stopper 51, and the backlash of the movable core upon collision with the stopper 51 is suppressed, thus it is possible to suppress vibration of the main contact movable member interlocked with the backlash. Note that the stopper 51 itself may have a shock absorbing function.

Figure 3:
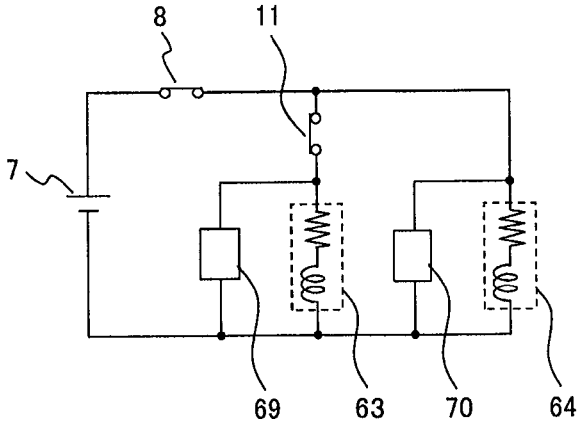
FIG. 3 is a circuit structure diagram of an electromagnet employed in the embodiment 1 of the actuator for a contactor according to the present invention.

Next, the circuit structure of the electromagnet 60 in the present embodiment will be described using FIG. 3.

In the figure, upon closing of the main contact, first, a direct current power switch 8 is turned ON, then an electric current is supplied from a direct current power source 7 via the direct current power switch 8 to the closing coil 63 and the holding coil 64. Immediately before the completion of the closing operation, the auxiliary contact switch 11, interlocked with the wipe spring holder 41, is turned OFF, then only the energization to the closing coil 63 is interrupted. As a result, only the holding coil 64 is in the energizing status and the closed status of the main contact is held.

At this time, when the number of coil turns is adjusted such that the ratio between the resistance of the closing coil 63 and the coil wire resistance of the holding coil 64 is e.g. about 1:20, it is possible to limit the electric current upon holding of closed status and save energy while ensuring electric current necessary for the closing operation.

Further, diodes 69 and 70, as countermeasures against a counter electromotive force which occurs upon coil energization cut-off time, are respectively connected in parallel to the closing coil 63 and the holding coil 64. It may be arranged such that plural diodes 69 and 70 are serially connected or connected in parallel. Otherwise, a voltage limiter such as a varistor may be connected in parallel to the diodes 69 and 70.

With this arrangement, the resistance with respect to surge voltage such as a counter electromotive force is improved, and it is possible to further improve the operational reliability of the actuator.

Note that it is effective that the surge voltage countermeasure device such as the diodes 69 and 70 or the varistor is provided on the side of the auxiliary contact 10. That is, by intensively providing devices requiring electric wiring on one side in this manner, the accessibility is improved, and the operability upon assembling and maintenance is improved.

According to the present embodiment as described above, it is possible to provide the trip spring 31 and the auxiliary contact 10 adjacently to the electromagnet 60, and it is possible to suppress the coil excitation power upon holding of closed status without space for installation of the trip spring 31 between the electromagnet 60 and the case side wall 2 and without current limiting resistor. Accordingly, it is possible to downsize the case 1 and downsize the entire device. Further, it is possible to improve the safety by using the machine-operation type auxiliary contact 10, which becomes in the open status when failure occurs, for timing control of energization to the closing coil 63 and the holding coil 64.

[Embodiment 2]

Figure 4:
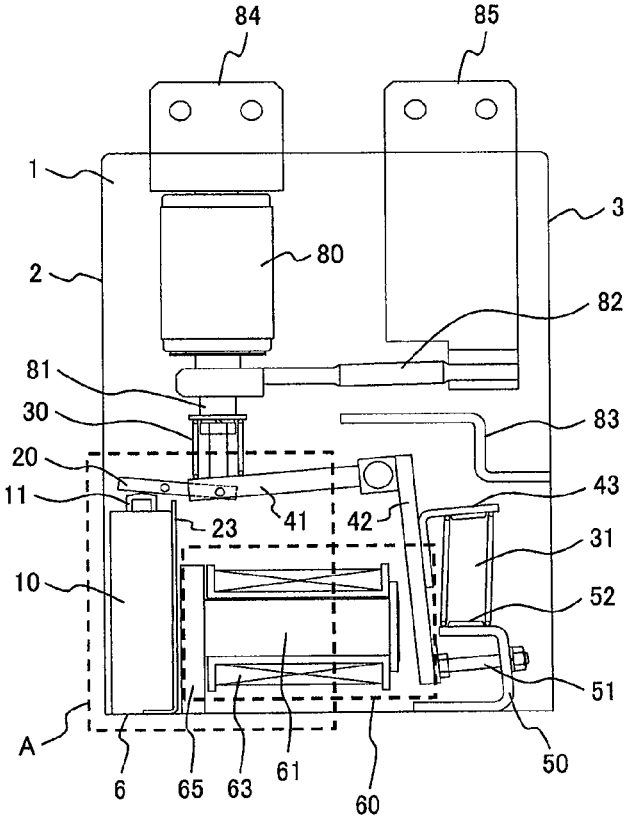
FIG. 4 is a configuration diagram showing an embodiment 2 of the actuator for a contactor according to the present invention, and showing the inside of the case from the position in front of the case.
Figure 5:
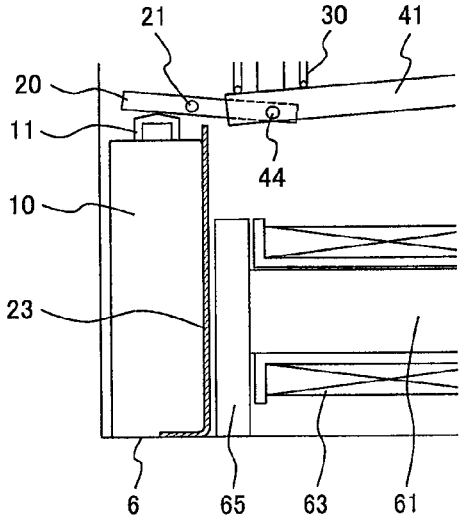
FIG. 5 is an enlarged diagram of a part A in FIG. 4.

FIG. 4 and FIG. 5 show an embodiment 2 of the actuator for a contactor according to the present invention.

The characteristic feature of the present embodiment shown in the figures is that the magnetic shield 23 is provided between the auxiliary contact 10 and the yoke 65. Other constituent elements are similar to those in the embodiment 1.

According to the present embodiment, it is possible to obtain, in addition to effects similar to those in the embodiment 1, an effect that the magnetic shield 23 prevents arrival of stray magnetic field generated from the closing coil 63 and the holding coil 64 around the auxiliary contact 10, to prevent erroneous operation of the auxiliary contact 10. Note that in the magnetic shield, when the length in the drawing depthwise direction of FIG. 4 and FIG. 5 is longer than the yoke 65, it is possible to improve the effect of shielding against the stray magnetic field generated from the closing coil 63 and the holding coil 64.

Further, when the magnetic shield 23 is fixed to the case side walls 4 and 5, it can be used not only as a magnetic shield member but also as a reinforcing member (rib) for the case 1. In this case, as the deflection is lowered by increasing the rigidity of the case 1, it is possible to suppress energy required in operations of the movable members such as the movable core 42.

[Embodiment 3]

Figure 6:
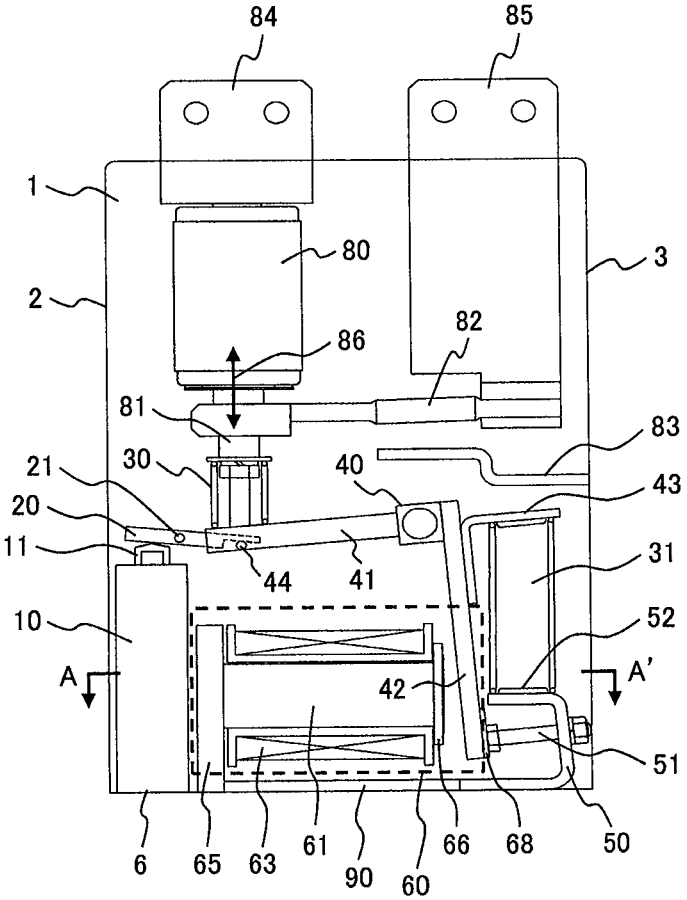
FIG. 6 is a configuration diagram showing an embodiment 3 of the actuator for a contactor according to the present invention, and showing the inside of the case from the position in front of the case.

FIG. 6 shows an embodiment 3 of the actuator for a contactor according to the present invention.

The characteristic feature of the present embodiment shown in the figure is that a magnetic path 90 is provided, in close contact with the yoke 65 and the stopper support base 50, on the case bottom surface 6, and a gap piece 68 of non-magnetic material is inserted between the stopper 51 and the movable core 42. Other constituent elements are similar to those in the embodiment 1. Note that the stopper support base 50 and the stopper 51 are made of magnetic material.

With this structure, immediately after the start of energization to the closing coil 63 and the holding coil 64 in the interrupted status, a magnetic circuit from the yoke 65 via the magnetic path 90 and the stopper support base 50 and the stopper 51 through the movable core 42 is formed, and it is possible to attract the movable core 42 to the stopper 51 side for a while. In accordance with increment in the energizing current in the closing coil 63 and the holding coil 64, the movable core 42 is attracted to the magnetic pole 66 side, and starts in a short time. It is possible to delay the timing of start of the movable core 42 by providing the magnetic path 90.

Further, as energy storing in the wipe spring 41 is started in the middle of the closing operation, the load power of the electromagnet 60 is discontinuously increased in the middle of the closing operation. At this time, when the timing of start of the movable core 42 is delayed until the energizing current to the closing coil 63 and the holding coil 64 becomes sufficiently high, the movable core 42 starts in a status where the attraction force to the magnetic pole 66 side acting on the movable core 42 is further increased.

Therefore, according to the present embodiment, it is possible to obtain, in addition to effects similar to those in the embodiment 1, an effect that even though the load power is discontinuously increased during the closing operation, the movable core 42 obtains a sufficient attraction force and can more easily complete the closing operation without stoppage.

Further, it is possible to control the timing of start of the movable core 42 by adjusting the thickness of the gap piece 68 of non-magnetic material, inserted between the stopper 51 and the movable core 42, or by adjusting the cross-sectional areas of the stopper support base 50, the stopper 51, and the magnetic path 90. Note that it may be arranged such that the thickness of the case bottom surface 6 is sufficiently large, and it is used in substitution for the magnetic path 90.

Note that the present invention is not limited to the above-described embodiments but includes various modifications. For example, the above-described embodiments are detailed descriptions as assistance for understanding the present invention, and the invention is not limited to an embodiment having all the described constituent elements. Further, it is possible to replace a part of the constituent elements of one embodiment with those of other embodiment(s). Further, it is possible to add the constituent elements of one embodiment to those of other embodiment(s). Further, it is possible to add/delete/replace a part of the constituent elements of each embodiment with those of other embodiment(s).

REFERENCE SIGNS LIST

1 . . . case, 2, 3, 4 and 5 . . . case side wall, 6 . . . case bottom surface, 7 . . . direct current power source, 8 . . . direct current power switch, 10 . . . auxiliary contact, 11 . . . auxiliary contact switch, 20 . . . lever, 21, 44 . . . pin, 23 . . . magnetic shield, 30 . . . wipe spring, 31 . . . trip spring, 40 . . . shaft, 41 . . . wipe spring holder, 42 . . . movable core, 43, 52 . . . spring holder, 50 . . . stopper support base, 51 . . . stopper, 60 . . . electromagnet, 61, 62 . . . fixed core, 63 . . . closing coil, 64 . . . holding coil, 65 . . . yoke, 66, 67 . . . magnetic pole, 68 . . . gap piece, 69, 70 . . . diode, 80 . . . interrupting unit, 81 . . . main contact movable member, 82 . . . flexible conductor, 83 . . . insulating plate, 84, 85 . . . terminal, and 90 . . . magnetic path.

The invention claimed is:

1. An actuator for a contactor comprising:

an electromagnet having a closing coil, a holding coil, fixed cores wound with the closing coil and the holding coil respectively, a movable core provided on a first side of the fixed cores, and a yoke provided on a second side of the fixed cores, opposite the first side of the fixed cores, wherein a main contact movable member operates to perform electrical closing or interrupting operation of a main contact of an interrupting unit by attraction or release of the movable core of the electromagnet with respect to the fixed core, wherein the actuator further comprises: a trip spring that is energy-stored during the closing operation of the main contact of the interrupting unit and performs the interrupting operation of the main contact of the interrupting unit upon stopping the energization to the holding coil and thereby releasing the stored energy; and an auxiliary contact that operates with the operation of the movable core and performs energization switching with respect to the closing coil and the holding coil, and wherein the trip spring is provided on a first side of the electromagnet in a horizontal direction while the auxiliary contact is provided on a second side of the electromagnet, opposite the first side of the electromagnet.

2. The actuator for a contactor according to claim 1, further comprising:

a stopper with which the movable core collides;

a stopper support base configured to support the stopper; and spring holders provided to the movable core and the stopper support base respectively, and wherein the trip spring is provided between the spring holder of the movable core and the spring holder of the stopper support base, wherein the auxiliary contact is interlocked with the operation of the movable core and is provided on a first side of the yoke opposite to a second side of the yoke which is provided on the second side of the fixed cores, and wherein the auxiliary contact controls energization timing of the closing coil and the holding coil having coil resistance higher than that of the closing coil.

3. The actuator for a contactor according to claim 2, further comprising a case configured to house the electromagnet, wherein the stopper support base is fixed to a bottom surface of the case on the first side of the electromagnet, and the stopper support base supports the trip spring.

4. The actuator for a contactor according to claim 2, wherein magnetic poles are provided, respectively, on the first side of each of the fixed cores, and a distance between the magnetic poles and the movable core is adjustable with the stopper.

5. The actuator for a contactor according to claim 2, further comprising a wipe spring, and a wipe spring holder, and wherein the wipe spring holder is connected via a shaft to a first side of the movable core opposite to a second side of the movable core with which the stopper collides, and the wipe spring is provided between the wipe spring holder and the main contact movable member.

6. The actuator for a contactor according to claim 5, further comprising a pin provided in a first portion of the wipe spring holder opposite to a second portion of the wipe spring holder to which the first side of the movable core is connected, and a lever provided above the auxiliary contact and being interlocked with the pin and thereby operating the auxiliary contact.

7. The actuator for a contactor according to claim 5, wherein part of the wipe spring holder is extended above the auxiliary contact, and the auxiliary contact is operated with the extended part of the wipe spring holder.

8. The actuator for a contactor according to claim 2, wherein a magnetic path is provided, in close contact with the yoke and the stopper support base, on a bottom surface of the case.

9. The actuator for a contactor according to claim 8, wherein the stopper and the stopper support base are made of non-magnetic material.

10. The actuator for a contactor according to claim 2, further comprising a gap piece made of non-magnetic material provided between the stopper and the movable core.

* * * * *